US006523550B2

(12) United States Patent
McCormick

(10) Patent No.: US 6,523,550 B2
(45) Date of Patent: Feb. 25, 2003

(54) APPLICATION DEVICE

(76) Inventor: John McCormick, 350 Manhattan Ave., North Babylon, NY (US) 11703

( * ) Notice: Subject to any disclaimer, the term of this patent is extended or adjusted under 35 U.S.C. 154(b) by 0 days.

(21) Appl. No.: 09/732,549

(22) Filed: Dec. 8, 2000

(65) Prior Publication Data

US 2002/0069891 A1 Jun. 13, 2002

(51) Int. Cl.[7] ..... A45D 34/04

(52) U.S. Cl. ..... 132/320; 15/144.4; 15/210.1; 401/205; 401/265

(58) Field of Search ..... 132/320, 74.5, 132/108, 109, 110, 111, 112; D28/7; 401/6, 265, 263, 261, 139, 266, 205, 206, 96; 15/144.4, 104.44, 209.1, 244.1, 210.1

(56) References Cited

U.S. PATENT DOCUMENTS 2,314,394 A * 3/1943 Guy ..... 401/263
2,742,660 A * 4/1956 Van Esley ..... 401/205
3,103,682 A * 9/1963 Markle ..... 401/132
4,135,274 A * 1/1979 Freeman ..... 15/244 R
4,483,636 A * 11/1984 Meyer ..... 401/266
4,961,661 A * 10/1990 Sutton et al. ..... 401/6
5,088,849 A * 2/1992 Johnson et al. ..... 401/44
5,454,659 A * 10/1995 Vosbikian et al. ..... 401/207
5,846,011 A * 12/1998 Bernstein et al. ..... 401/205
D404,125 S * 1/1999 Weinstein ..... D24/119
5,931,591 A * 8/1999 McCracken ..... 401/6
6,309,126 B1 * 10/2001 Narula et al. ..... 401/202
6,360,753 B1 * 3/2002 Vickers ..... 132/320

* cited by examiner

*Primary Examiner*—Kevin Shaver
*Assistant Examiner*—David Comstock

(57) ABSTRACT

An application device for applying a wide variety of lotions and creams to the body. The application device includes a head portion that includes a first end, a second end, a top wall, a bottom wall and peripheral edge integrally coupled to and extending between the top and bottom walls such that a chamber is defined. The bottom wall includes a plurality of holes extending therethrough. A solution is positioned in the chamber. A handle member is integrally coupled to a central portion of the top wall. The handle member includes a first end, a second end and a peripheral wall extending therebetween. An absorbent member for absorbing the solution from the chamber through each of the holes in the bottom wall is securably attached to an outer surface of the bottom wall.

13 Claims, 4 Drawing Sheets

APPLICATION DEVICE

BACKGROUND OF THE INVENTION

1. Field of the Invention

The present invention relates to lotion applicators and more particularly pertains to a new application device for applying a wide variety of lotions and creams to the body.

2. Description of the Prior Art

The use of lotion applicators is known in the prior art. More specifically, lotion applicators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,103,682; U.S. Pat. No. 5,360,111; U.S. Pat. No. 4,483,356; U.S. Pat. No. 5,692,261; U.S. Pat. No. 4,381,766; U.S. Pat. No. 5,664,281; and U.S. Pat. No. Des 394,108.

While these devices fulfill their respective, particular objectives and requirements, the aforementioned patents do not disclose a new application device. The inventive device includes a head portion having a first end, a second end, a top wall, a bottom wall and peripheral edge integrally coupled to and extending between the top and bottom walls such that a chamber is defined. The bottom wall includes a plurality of holes extending therethrough. A solution is positioned in the chamber. A handle member is integrally coupled to a central portion of the top wall. The handle member includes a first end, a second end and a peripheral wall extending therebetween. An absorbent member for absorbing the solution from the chamber through each of the holes in the bottom wall is securably attached to an outer surface of the bottom wall.

In these respects, the application device according to the present invention substantially departs from the conventional concepts and designs of the prior art, and in so doing provides an apparatus primarily developed for the purpose of applying a wide variety of lotions and creams to the body.

SUMMARY OF THE INVENTION

In view of the foregoing disadvantages inherent in the known types of lotion applicators now present in the prior art, the present invention provides a new application device construction wherein the same can be utilized for applying a wide variety of lotions and creams to the body.

The general purpose of the present invention, which will be described subsequently in greater detail, is to provide a new application device apparatus and method which has many of the advantages of the lotion applicators mentioned heretofore and many novel features that result in a new application device which is not anticipated, rendered obvious, suggested, or even implied by any of the prior art lotion applicators, either alone or in any combination thereof.

To attain this, the present invention generally comprises a head portion having a first end, a second end, a top wall, a bottom wall and peripheral edge integrally coupled to and extending between the top and bottom walls such that a chamber is defined. The bottom wall includes a plurality of holes extending therethrough. A solution is positioned in the chamber. A handle member is integrally coupled to a central portion of the top wall. The handle member includes a first end, a second end and a peripheral wall extending therebetween. An absorbent member for absorbing the solution from the chamber through each of the holes in the bottom wall is securably attached to an outer surface of the bottom wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new application device apparatus and method which has many of the advantages of the lotion applicators mentioned heretofore and many novel features that result in a new application device which is not anticipated, rendered obvious, suggested, or even implied by any of the prior art lotion applicators, either alone or in any combination thereof.

It is another object of the present invention to provide a new application device which may be easily and efficiently manufactured and marketed.

It is a further object of the present invention to provide a new application device which is of a durable and reliable construction.

An even further object of the present invention is to provide a new application device which is susceptible of a low cost of manufacture with regard to both materials and labor, and which accordingly is then susceptible of low prices of sale to the consuming public, thereby making such application device economically available to the buying public.

Still yet another object of the present invention is to provide a new application device which provides in the apparatuses and methods of the prior art some of the advantages thereof, while simultaneously overcoming some of the disadvantages normally associated therewith.

Still another object of the present invention is to provide a new application device for applying a wide variety of lotions and creams to the body.

Yet another object of the present invention is to provide a new application device which includes a head portion includes a first end, a second end, a top wall, a bottom wall and peripheral edge integrally coupled to and extending between the top and bottom walls such that a chamber is defined. The bottom wall includes a plurality of holes extending therethrough. A solution is positioned in the chamber. A handle member is integrally coupled to a central portion of the top wall. The handle member includes a first end, a second end and a peripheral wall extending therebetween. An absorbent member for absorbing the solution from the chamber through each of the holes in the bottom wall is securably attached to an outer surface of the bottom wall.

Still yet another object of the present invention is to provide a new application device that is compact and portable allowing it to be easily carried. By having a telescoping handle, the present invention can be placed in carrying devices that would otherwise not accommodate a long handled lotion applicator.

Even still another object of the present invention is to provide a new application device that can be used by the elderly and handicapped to apply a wide variety of lotions, including medical lotions to difficult to reach parts of their bodies.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
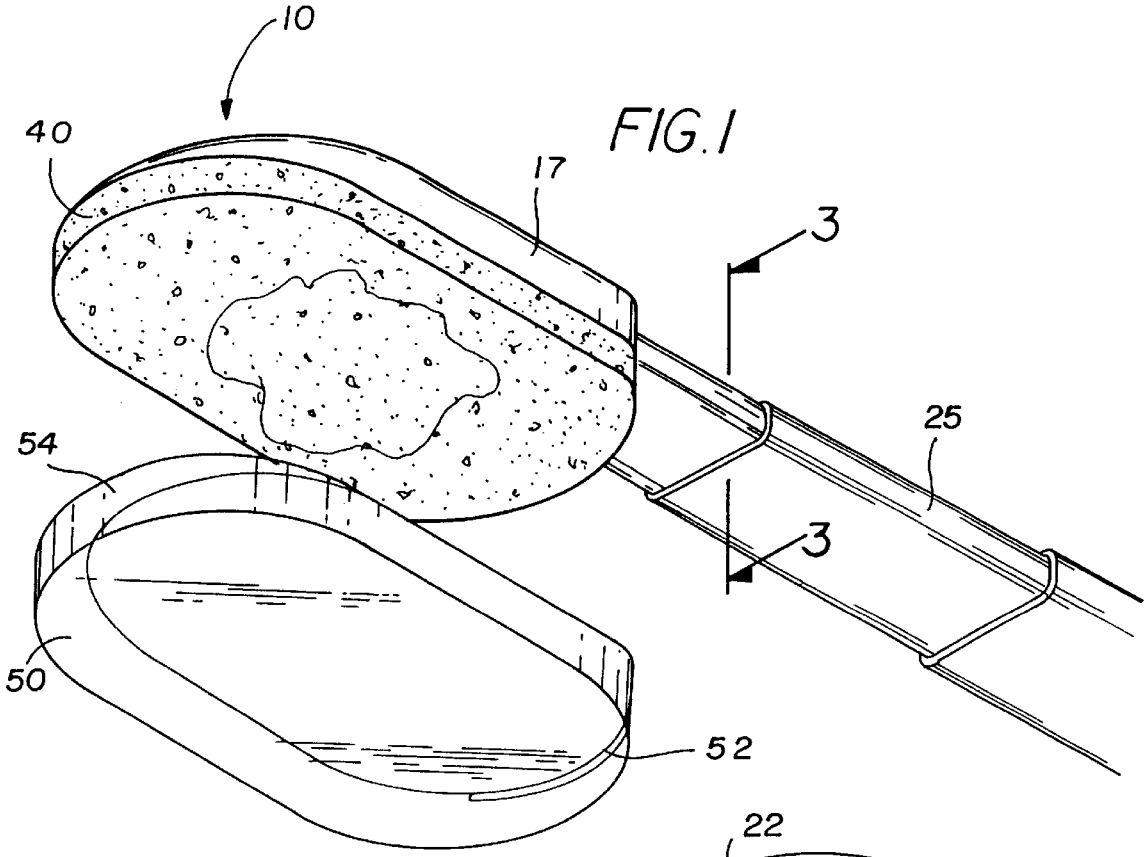
FIG. 1 is a schematic perspective view of a new application device according to the present invention.
Figure 2:
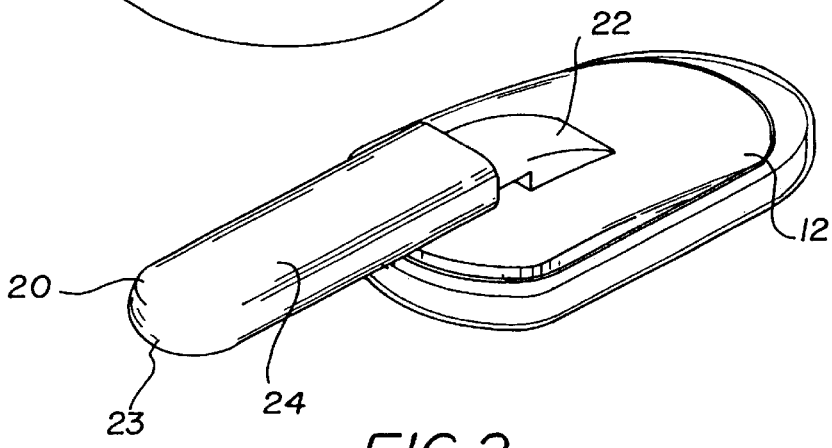
FIG. 2 is a schematic perspective view of the present invention showing a head portion resting in a cover.
Figure 3:
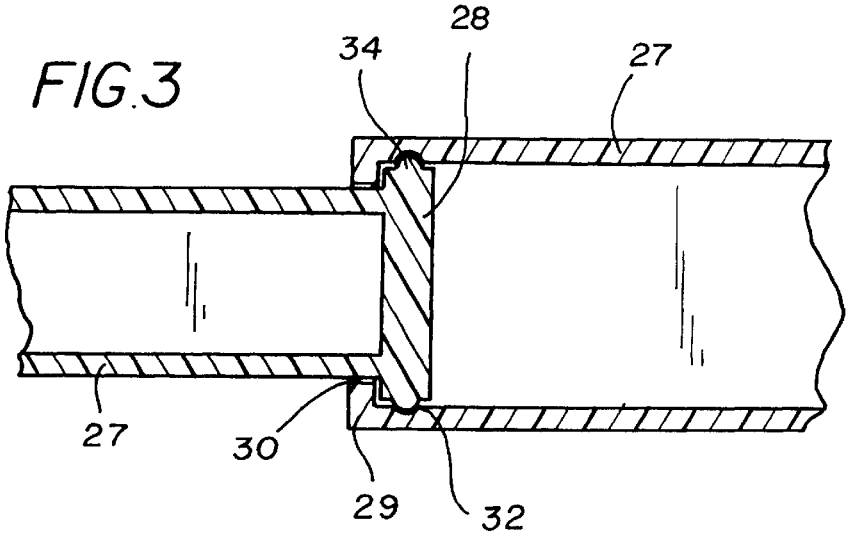
FIG. 3 is a schematic partial cross-sectional view of the present invention showing the handle member.
Figure 4:
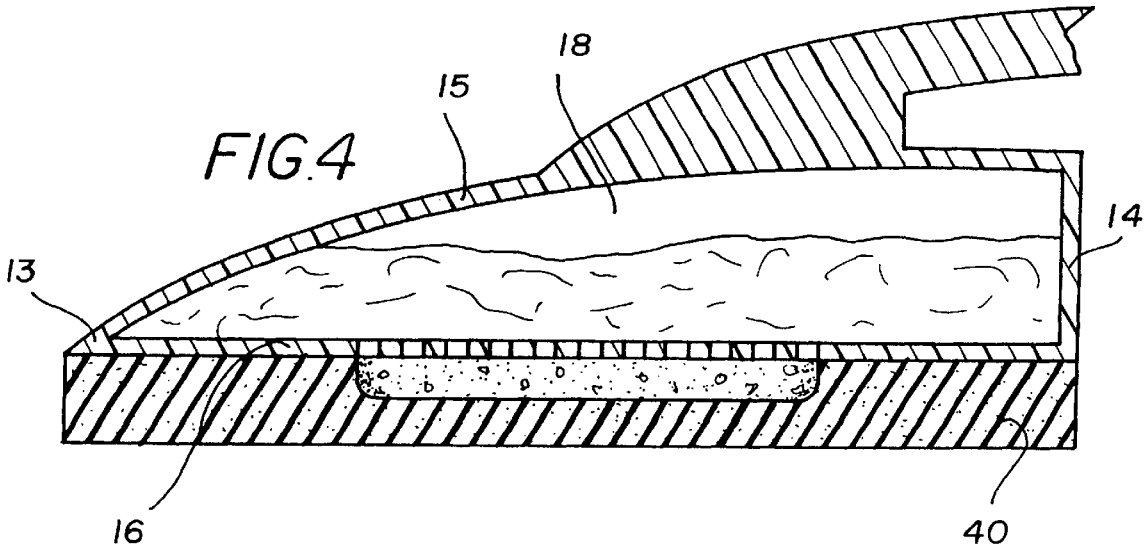
FIG. 4 is a schematic cross-sectional view of the present invention showing a lotion in the head portion.
Figure 5:
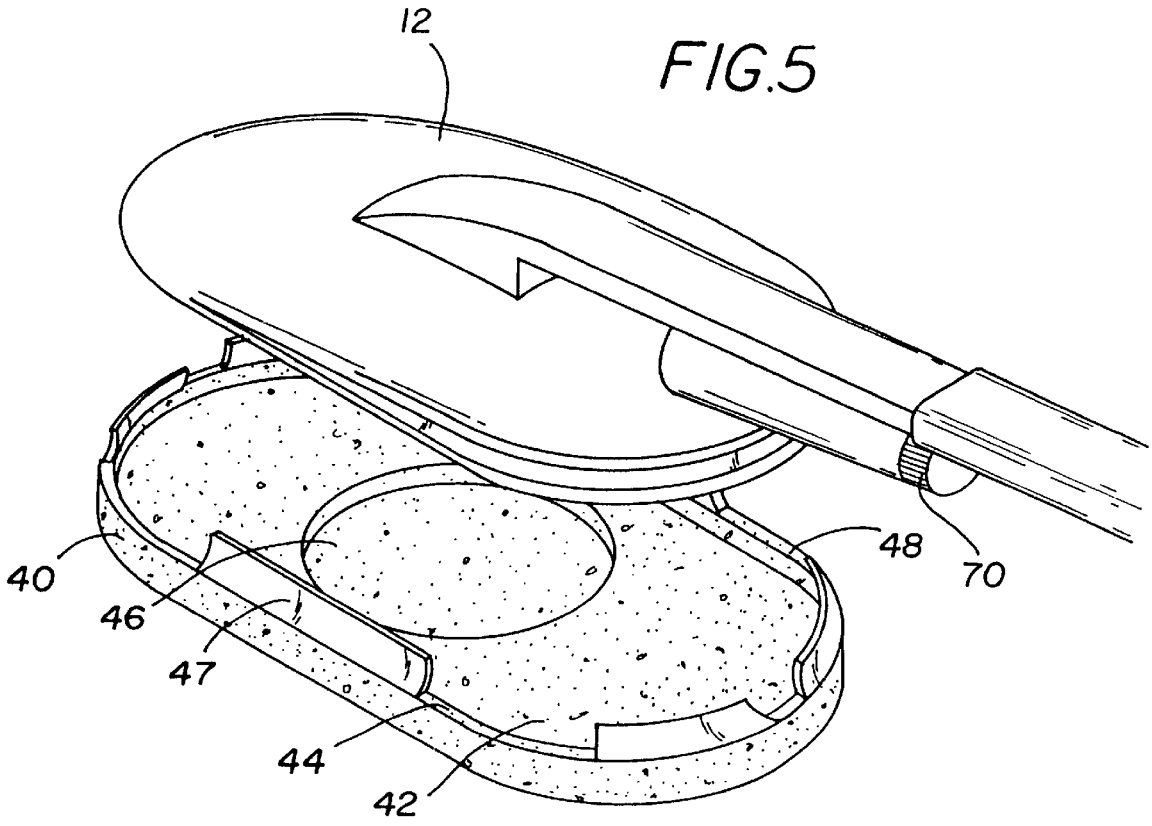
FIG. 5 is a schematic perspective view of the present invention showing another embodiment utilizing replaceable absorbent members and having a refillable head portion.
Figure 6:
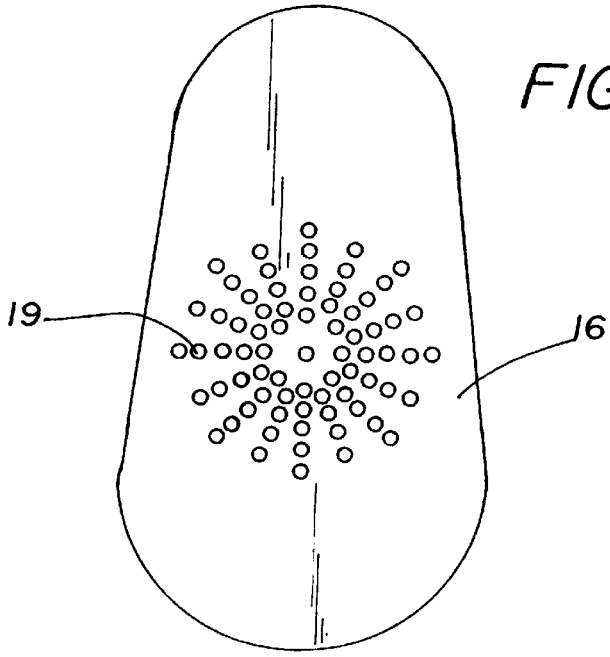
FIG. 6 is a schematic bottom view of the present invention showing a plurality of holes in a bottom wall of the head portion.
Figure 7:
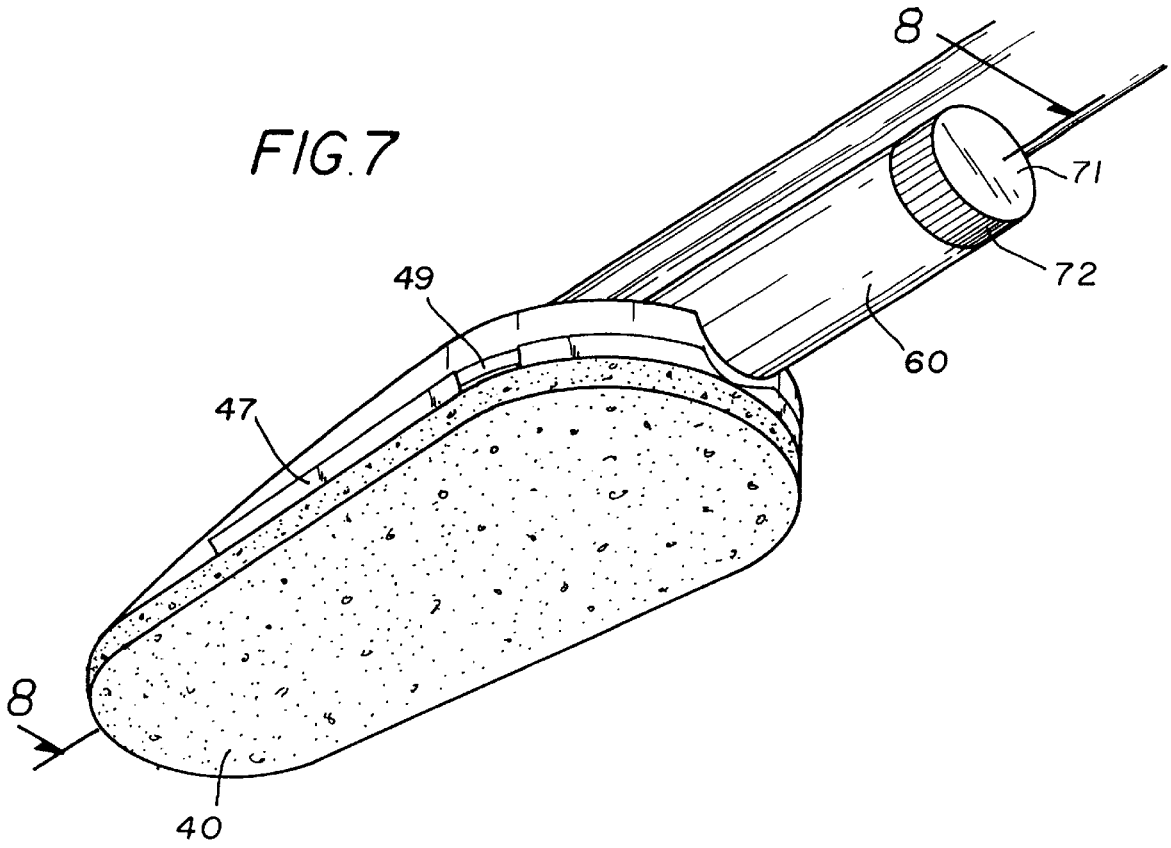
FIG. 7 is a schematic perspective view of the present invention showing the replaceable absorbent member being attached to the head portion.
Figure 8:
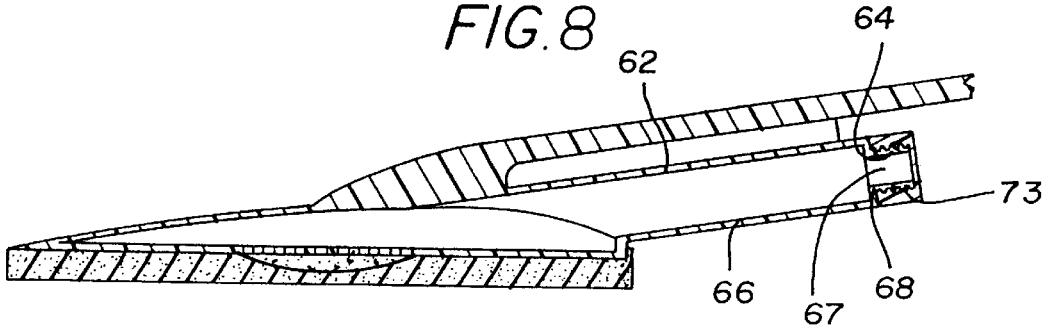
FIG. 8 is a schematic cross-sectional view of the present invention taken along line 8—8.

With reference now to the drawings, and in particular to FIGS. 1 through 8 thereof, a new application device embodying the principles and concepts of the present invention and generally designated by the reference numeral 10 will be described.

As best illustrated in FIGS. 1 through 8, the application device 10 generally comprises a head portion 12. The head portion 12 includes a first end 13, a second end 14, a top wall 15, a bottom wall 16 and peripheral edge 17 integrally coupled to and extending between the top and bottom walls such that a chamber 18 is defined. The bottom wall 16 includes a plurality of holes 19 extending therethrough. The peripheral edge 17 tapers from the second end 14 to the first end 13. A solution is positioned in the chamber 18 during the manufacturing of the invention. The solution may be any type of lotion, cream or liquid soap that can easily flow through the plurality of holes 19.

The application device 10 also includes a handle member 20. The handle member 20 includes a first end 22, a second end 23 and a peripheral wall 24 extending therebetween. The first end 22 of the handle member 20 is integrally coupled to a central portion of the top wall 15. The handle member 20 is telescoping such that a plurality of handle member sections 25 is defined. In an embodiment each of the sections 25 is extendably positionable in one of an adjacent sections 25.

Each of the sections 25 comprises a tubular member 27. Each of the tubular members 27 includes a first end 28 and a second end 29. The second end 29 includes an opening 30 extending therein. An inner surface of the peripheral wall 24 includes a pair of wells 32 extending therein. Each of the wells 32 is positioned generally adjacent to the second end 29 of the tubular member 27. The wells 32 are positioned generally opposed to each other.

A pair of flanges 34 is integrally coupled to and extending outwardly away from the peripheral wall 24 of each of the handle member sections 25. Each of the flanges 34 is positioned generally adjacent to the first end 28 of tubular member 27. Each of the flanges 34 is positioned to releasably engage one of the wells 32. The flanges 34 being positioned in the wells 32 maintains the handle member in an extended position.

An absorbent member 40 for absorbing the solution from the chamber 18 through each of the holes 19 in the bottom wall 16. The absorbent member 40 is securably attached to an outer surface of the bottom wall 16. The absorbent member 40 comprises a sponge or an absorbent synthetic material such as foam.

To prevent the absorbent member 40 from drying out there is a covering means 50 for covering the absorbent member 40. The covering means 50 includes a panel 52 having a perimeter wall 54 integrally coupled thereto and extending upwardly therefrom such that the covering means 50 has an open top side. The covering means 50 includes a shape designed for removably receiving the head member 12. The covering means 50 comprises a substantially rigid material such as plastic.

In another embodiment of the present invention there is a cylinder 60 designed for placing the solution in the chamber 18 of the head portion 12. The cylinder 60 includes a first end 62, a second end 64 and a peripheral wall 66 extending therebetween. The first end 62 is integrally coupled to the second end 14 of the head portion 12. The second end 64 of the cylinder 60 includes an opening 67 extending therein. The opening 67 extends from the second end 64 of the cylinder 60 into the chamber 18. The peripheral wall 66 of the cylinder 60 includes a plurality of threads 68 therein.

A covering means 70 for covering the second end 64 of the cylinder 60. The covering means 70 includes a base wall 71 and an annular wall 72 integrally coupled thereto extending upwardly therefrom. The annular wall 72 includes a plurality of threads 73 extending therein. Each of the threads 66 of the cylinder 60 is designed for releasably engaging each of the threads 73 of the covering means 70. The covering means comprises a cap.

In this embodiment the absorbent member 40 may be replaceable due to wear. The absorbent member 40 in this embodiment includes a bottom wall 42 and a perimeter wall 44 integrally coupled thereto and extending upwardly therefrom. The absorbent member 40 is releasably coupled to the head portion 12. An upper surface of the absorbent member 40 includes a well 46 extending therein. The well 46 is adapted for fluidly receiving the solution and dispersing it throughout the absorbent member 40.

There is a plurality of fastening means 47 for fastening the absorbent member 40 to the head portion 12. Each of said fastening means 48 is securably attached to a free end 48 of the perimeter wall 44 of the absorbent member 40. The fastening means are designed for releasably engaging a perimeter groove 49 of the head portion. Each of the fastening means 47 comprising a clip.

In use, a solution is either already positioned in the chamber 18 of the head portion 12 or is poured into the chamber 18 through the cylinder 60. Once the solution is placed into the chamber 18 a user may extend the handle member 20 to the length desired. The user then massages the absorbent member 40 on the body until the solution begins to be applied to the skin.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An application device for applying lotions and creams on a body of a user, said device comprising:

a head portion having a first end, a second end, a top wall, a bottom wall and peripheral edge coupled to and extending between said top and bottom walls such that a chamber is defined, a solution being positioned in said chamber, said bottom wall having a plurality of holes extending therethrough;

a handle member having a first end, a second end and a peripheral wall extending therebetween, said first end of said handle member being coupled to a central portion of said top wall and being angled away from said top wall;

an absorbent member for absorbing the solution from said chamber through each of said holes in said bottom wall, said absorbent member being attached to said bead portion and being positioned adjacent to an outer surface of said bottom wall, said absorbent member having a well for fluidly receiving the solution from said chamber through said plurality of holes; and said well comprising a circular recess extending into an upper surface of said absorbent member with a perimeter surface oriented substantially perpendicular to a plane of said upper surface, said well and having a depth generally equal to one half of a thickness of said absorbent member.

2. The application device of claim 1, wherein said handle member includes a plurality of telescoping handle member sections, wherein each of said sections is extendably positionable in one of an adjacent sections, each of said sections comprising:

a tubular member having a first end and a second end, said second end having an opening extending therein, an inner surface of said peripheral wall having a pair of wells extending therein, each of said wells being positioned generally adjacent to said second end of said tubular member, said wells being opposed to each other; and a pair of flanges integrally coupled to and extending outwardly away from said peripheral wall of each of said handle member sections, each of said flanges being positioned generally adjacent to said first end of said tubular member, each of said flanges being positioned to releasably engage one of said wells.

3. The application device of claim 1, further comprising: a covering means for covering said absorbent member.

4. The application device of claim 3, wherein said covering means includes a panel, said panel having a perimeter wall integrally coupled thereto and extending upwardly therefrom such that said covering means has an open top side, said covering means having a shape adapted for removably receiving said head member.

5. The application device of claim 1, wherein said plurality of holes comprises a center hole and a plurality of sets of holes extending outward in a radial manner an equal distance from said center hole such that said plurality of holes forms a generally star-shaped circular pattern.

6. The application device of claim 1, wherein a diameter of said well is generally equal to a diameter of said circular pattern of said plurality of holes such that the solution is permitted to pass through to said well to facilitate an even distribution of said solution throughout said absorbent member when applied to the body of the user.

7. An application device for applying lotions and creams on a body of a user, said device comprising:

a head portion, said head portion having a first end, a second end, a top wall, a bottom wall and peripheral edge integrally coupled to and extending between said top and bottom walls such that a chamber is defined, said bottom wall having a plurality of holes extending therethrough, said peripheral edge having an arcuate perimeter groove extending therein;

a handle member, said handle member having a first end, a second end and a peripheral wall extending therebetween, said first end of said handle member being integrally coupled to a central portion of said top wall and being angled away from said top wall;

an elongate cylinder adapted for placing a solution in said chamber of said head portion, said cylinder having a first end, a second end and a peripheral wall extending therebetween defining an interior, said first end being integrally coupled to said second end of said head portion such that said interior of said cylinder is in fluid communication with said chamber of said head portion, said cylinder having a length being generally one half of a length of said head portion such that said cylinder functions as an extension of said chamber thereby expanding the capacity of said chamber, said cylinder being angled with respect to said head portion and being oriented substantially parallel to said handle portion such that the solution is gravitationally biased into said chamber when said bottom wall of said head portion is oriented downwardly;

an absorbent member for absorbing the solution from said chamber through each of said holes in said bottom wall of said head portion, said absorbent member having a bottom wall and a perimeter wall integrally coupled thereto and extending upwardly therefrom, said absorbent member being releasably coupled to said head portion; and a plurality of fastening means for fastening said absorbent member to said head portion, each of said fastening means being securably attached to a free end of said perimeter wall of said absorbent member.

8. The application device of claim 7, wherein said second end of said cylinder has an opening extending therein and into said chamber, said peripheral wall of said cylinder having a plurality of threads therein; and a covering means for covering said second end of said cylinder, said covering means having a base wall and an annular walk integrally coupled thereto extending upwardly therefrom, said annular wall having a plurality of threads extending therein, each of said threads of said cylinder being adapted for releasably engaging each of said threads of said covering means, said covering means comprising a cap.

9. The application device of claim 7, wherein said handle member includes a plurality of telescoping handle member sections, wherein each of said sections is extendably positionable in one of an adjacent sections, each of said handle member sections comprising:

a tubular member having a first end and a second end, said second end of said tubular member having an opening extending therein, an inner surface of said peripheral wall having a pair of wells extending therein, each of said wells being positioned generally adjacent to said second end of said tubular member, said wells being opposed to each other; and a pair of flanges integrally coupled to and extending outwardly away from said peripheral wall of each of said handle member sections, each of said flanges being positioned generally adjacent to said first end of said tubular member, each of said flanges being positioned to releasably engage one of said wells.

10. The application device of claim 7, wherein each of said fastening means comprises an arcuate clip member for engaging said groove in said peripheral wall of said head portion.

11. The application device of claim 7, wherein said absorbent member has a well for fluidly receiving the solution from said chamber through said plurality of holes in said bottom wall of said head portion, said well comprising a circular recess extending into an upper surface of said bottom wall of said absorbent member in a substantially perpendicular manner with respect to a plane of said upper surface and having a depth being generally equal to one half a thickness of said bottom wall of said absorbent member; and wherein a diameter of said well being generally equal to a diameter of said circular pattern of said plurality of holes such that the solution is permitted to pass through to said well to facilitate an even distribution of said solution throughout said absorbent member when applied to the body of the user.

12. The application device of claim 7, further comprising: a covering means for covering said absorbent member.

13. The application device of claim 12, wherein said covering means includes a panel, said panel having a perimeter wall integrally coupled thereto and extending upwardly therefrom such that said covering means has an open top side, said covering means having a shape adapted for removably receiving said head member.

* * * * *